United States Patent [19]

Schmidt

[11] Patent Number: 4,712,491

[45] Date of Patent: Dec. 15, 1987

[54] PROCESS AND APPARATUS FOR THE CONTROLLED BURNING OF A VERTICAL STACK OF SOLID FUEL

[75] Inventor: Lothar Schmidt, Munich, Fed. Rep. of Germany

[73] Assignee: Wamsler-Herd-Und Ofen GmbH, Munich, Fed. Rep. of Germany

[21] Appl. No.: 836,494

[22] Filed: Mar. 5, 1986

[30] Foreign Application Priority Data

Mar. 5, 1985 [EP] European Pat. Off. ..... 85102479.4

[51] Int. Cl.[4] ..... F23G 5/24

[52] U.S. Cl. ..... 110/346; 110/248; 110/251; 110/254

[58] Field of Search ..... 126/76, 77, 146, 222, 126/224–225; 110/235, 242, 248, 251, 254, 196, 315, 346

[56] References Cited

U.S. PATENT DOCUMENTS

| | | | |
|---|---|---|---|
| 2,146,531 | 2/1939 | Craigie | 110/254 |
| 2,442,124 | 5/1948 | Gilmore | 126/146 X |
| 2,461,068 | 2/1949 | Lockwood | 126/76 |
| 2,535,206 | 12/1950 | Hathaway | 110/251 |
| 2,666,403 | 1/1954 | Polk | 110/251 |
| 4,167,146 | 9/1979 | Wirth | 110/251 |

FOREIGN PATENT DOCUMENTS

| | | | |
|---|---|---|---|
| 1025597 | 3/1958 | Fed. Rep. of Germany | 110/251 |
| 2514589 | 10/1975 | Fed. Rep. of Germany | 126/224 |
| 0205514 | 11/1984 | Japan | 110/251 |

*Primary Examiner*—Margaret A. Focarino

*Attorney, Agent, or Firm*—Watson, Cole, Grindle & Watson

[57] ABSTRACT

The downward burning of a vertical stack of solid fuel in a vertical furnace shaft is controlled by supplying most of the combustion air to the side of the stack through vertically spaced apart rows of combustion air supply openings in the vertical furnace shaft, each row of combustion air supply openings being generally horizontally oriented and including a plurality of separate openings. Each row of combustion air supply openings is supplied with combustion air through a separate combustion air supply channel, and the combination air fed to each supply channel is controlled by a distribution element which shifts the supply of combustion air to lower rows of air supply openings as the combustion zone moves down to the bottom of the vertical stack.

17 Claims, 4 Drawing Figures

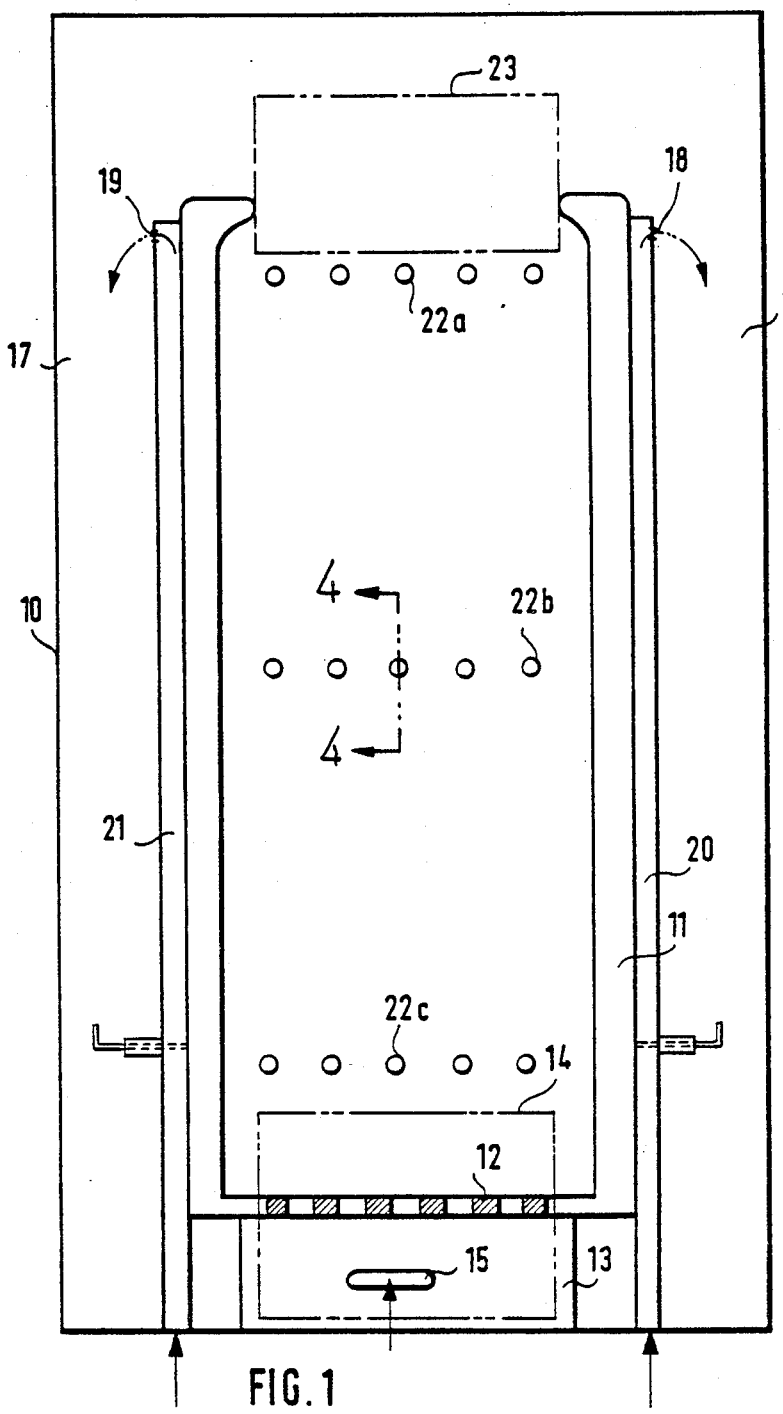
FIG. 1
FIG. 4
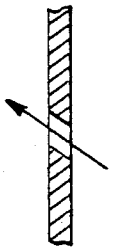

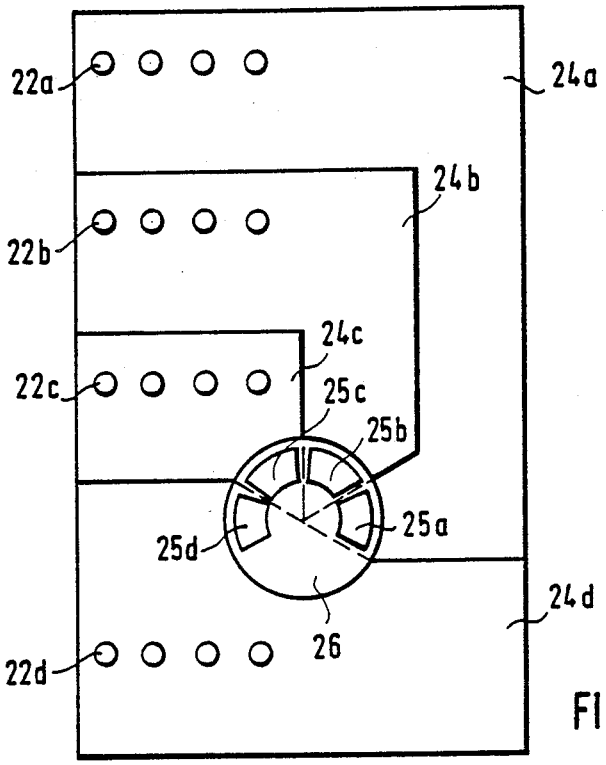
FIG. 2
FIG. 3
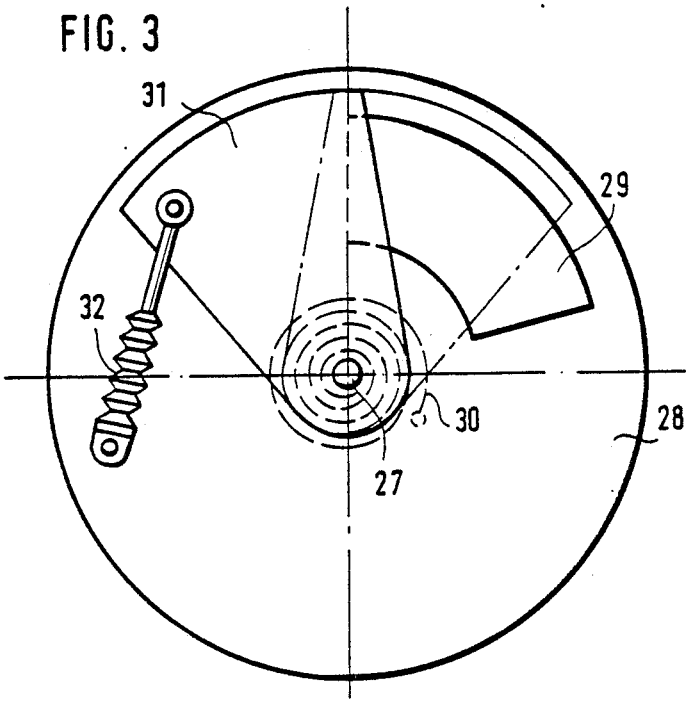

PROCESS AND APPARATUS FOR THE CONTROLLED BURNING OF A VERTICAL STACK OF SOLID FUEL

BACKGROUND OF THE INVENTION

1. Field of the Invention

This invention concerns a process for the controlled burning of a stack of solid fuel, particularly wood, which is located in a vertical furnace shaft, wherein the solid fuel is ignited at its top and allowed to burn downwardly to its bottom.

2. The Prior Art

In furnaces used for burning solid fuels, especially wood, it is very difficult to attain an even and hygienic combustion of a single charge of the solid fuel over a time period of several hours. In the known furnaces for burning solid fuels which have a vertical furnace shaft, the combustion is usually commenced at the bottom of the vertical stack of solid fuel. This means that the solid fuel (wood) is first stacked in the furnace shaft, the floor of which is constructed as grate, and the wood stack is then lit at its bottom. The combustion air needed for the combustion is led in from below through the grate and the combustion is led away at its side. Theoretically, the wood stack should burn evenly from the bottom and the fuel should slip down evenly from the top. However, in reality a burn-out-like condition occurs after a relatively short time, i.e., the total amount of wood in the furnace shaft becomes thermally decomposed, with the result being very high, but timewise limited, output peak, or else an intensive smoke development in the case where the waste gases cannot escape from the top. The reason for this is that a convective heat exchange occurs with the fuel located above the embers or that the hot waste gases resulting from the combustion heat up the wood above the bed of embers on their way up, i.e., in the event that exhaust of the combustion gases above the fuel is possible. However, according to the known state of the art, wood is already thermally decomposed at temperatures between 100° and 150° C., whereby combustible and easily flammable gases are formed which then lead in a short time to the noted reaction by the whole wood stack. Thus, a controlled, continuous and hygienic combustion is not attained.

For the foregoing reason, attempts have been made to work with a so-called combustion from the top, in which the wood stack is lit at its top surface so as to burn down from its top. However, in reality a burn-out of the whole wood stack occurs in a comparably short time. In this regard, the speed of flow of the combustion gases, fed in from the bottom, i.e., through the grate, through the wood stack to the top to the bed of embers is very small, so that the combustion air is heated far below the bed of embers because of the comparatively rapid progress of the heat transfer, with the consequence that the decomposition processes of the wood, as described above in connection with combustion from the bottom, occur here too, in this case progressing from top to bottom. Thus, the wood stack ignites from top to bottom and there is a burn-out as in the case of combustion from the bottom. Compared to the operation with combustion from the bottom, there is thus only the difference that the undesirable high output peak (burn-out) takes place with a certain time delay.

Though it is known from German Pat. No. 33 292 and German Patent Publication No. 31 42 394 to feed in combustion air from the side and to have it follow the embers, the combustion process takes place, however, from the end of the stack removed from the waste gas discharge, with the consequence that the hot waste gases have to flow through the unignited areas of the stack. Finally, it is known from German Patent Publication No. 28 04 968 for a boiler with top waste gas release and combustion from top to bottom, to lead combustion air from the top to the stack through a shiftable pipe and to have the pipe follow the continuous combustion of the stack towards the bottom. However, this blowing on the embers from the top requires the combustion air to be blown in under a comparatively high pressure since it must flow counter to the direction of flow of the escaping waste gases. In this manner, however, hot carbonization gases in the stack are pressed towards the bottom, which not only promotes a tarring of the lower parts of the combustion chamber but overall leads to an uncontrolled combustion because a lighting of the fuel by the noted carbonization gases. In addition, this known process is not suitable for individual furnaces because of the mechanical devices needed to control the lowering of the pipe and to provide the compressed air.

SUMMARY OF THE INVENTION

It is an object of the present invention to improve on a process of burning solid fuel wherein combustion is started at the top of a vertical stack of the solid fuel, such that a controlled, hygienic combustion with even output is attained without the danger of an uncontrolled burn-out or carbonization at low temperature of the whole load of fuel. In addition, it is an object of the invention to create a furnace for executing the process.

According to the invention most of the air needed for combustion of the solid fuel is supplied to the vertical stack of solid fuel along its side directly above the combustion zone (bed of embers), the location of this supply changing in increments as the combustion zone moves downwardly toward the bottom of the vertical stack. The invention assures that that part of the solid fuel (wood) which, as a reserve, is not yet supposed to be involved in the combustion, is neither subjected to a flow-through by the combustion waste gases nor to the combustion air that is to be supplied to the combustion area, and thus remains relatively below the decomposition temperature. In addition, the combustion zone (bed of embers) is clearly defined and remains relatively small or narrow. The sharp definition of the combustion zone without appreciable heating up of the fuel reserves also prevents to a large extent the production of decomposition and sulphur gas and thus provides for a very hygienic combustion, whereby the CO share, as tests have shown, remains clearly below 0.5% per volume. To guarantee a particularly narrow and clearly defined combustion zone, it is advantageous to work with very fine combustion air jets, and to increase the flow speed of the combustion air mechanically by means of pressure or suction.

The invention will now be better understood by reference to the attached drawings, taken in conjunction with the following discussion.

DESCRIPTION OF THE DRAWINGS

In the drawings,

FIG. 1 shows a schematic vertical section through a furnace constructed in accordance with one embodiment of the present invention, FIG. 2 shows a schematic view of the combustion air supply channels which lead to the combustion air supply openings in the vertical shaft of a furnace constructed in accordance with a second embodiment of the present invention, as well as the fixed cover disk which provides the channel inlet openings leading into the respective combustion air supply channels, and FIG. 3 shows a schematic view of a distribution disk which cooperates with the fixed cover disk shown in FIG. 2 to control the degree to which the channel inlet openings therein are covered or uncovered.

FIG. 4 is a sectional view taken along line 4—4 of FIG. 1.

DETAILED DESCRIPTION OF THE PREFERRED EMBODIMENT

A furnace according to a first preferred embodiment of the present invention is shown in FIG. 1. It includes a housing 10 which is made, at least in part, of a material having a high heat capacity, e.g., ceramic (stove tiles) or cast iron, and a vertical shaft 11 which is located inside the housing and which has a rectangular cross section. A grate 12 is positioned at the bottom of the vertical shaft 11, and under the grate 12 is a closed ash box 13 having an ash door 14. An air intake passage 15 having a certain cross sectional size extends from outside the furnace into the ash box 13. The top of the vertical shaft 11 is open and communicates with the upper ends of lateral downdraft flues 16 and 17 provided inside the furnace housing. Extending upwardly along the outside of the furnace shaft 11 are vertical air preheating channels 20 and 21 which have secondary air vents 18 and 20 located at their upper ends to discharge secondary air into the upper ends of the downdraft flues 16 and 17. On the rear side of the furnace shaft are shown three vertically spaced apart horizontal rows of combustion air supply openings, i.e., an upper row 22*a*, a middle row 22*b* and a lower row 22*c*. Each row is shown to have five individual combustion air supply openings. The total cross section of the five openings in each horizontal row considerably exceeds the cross section of the air intake passage 15. The housing also includes a fill door 23 to enable solid fuel to be supplied to the upper end of the vertical shaft 11.

FIG. 2 shows a schematic view of combustion air supply channels which lead to the combustion air inlet openings in the vertical shaft of a furnace according to a second embodiment of the invention, i.e., a furnace wherein the vertical shaft has four horizontal rows of combustion air supply openings, 22*a*, 22*b*, 22*c* and 22*d*. Also shown is a fixed cover disk 26 which includes four channel inlet openings 25*a*, 25*b*, 25*c* and 25*d* therein which respectively lead into the four combustion air supply channels, 22*a*, 22*b*, 22*c* and 22*d*. FIG. 3 shows a schematic view of a distribution disk which cooperates with the fixed cover disk 26 in FIG. 2 to determine the degree to which the channel inlet openings therein are covered (closed) or uncovered (opened). More specifically, the distribution disk 28 is rotatably mounted on a shaft 27 which is coaxial with the axis of the fixed cover disk 6, as can be seen from FIG. 3. The distribution disk 28 has a control opening 29 which corresponds to the channel inlet openings in the cover disk 26 (the distribution disk can be termed a punched disk). A bimetal spring 30 is connected, on the one hand, to the shaft 27 and, on the other hand, to the distribution disk 28. Finally, a sector-shaped movable flap 31 is mounted on the shaft 27, and a thermal adjustment device 32 is connected, on the one hand, to the distribution disk 28 and, on the other hand, to the movable flap 31.

In reality, the cover disk 26 and the distribution disk 28 have essentially the same diameter. The channel inlet openings 25*a*–25*d* of the cover disk 26 are registrable with the control opening 29 of the distribution disk 28 in such a way that, depending on the rotational positioning of the distribution disk 28, air input to one of the channels 24*a*, 24*b*, 24*c*, 24*d* is open fully or, correspondingly, flows partially into two adjoining channels (continuous transition can be achieved from one channel to the other). The rotation of the distribution disk 28 is done by the bimetal spring 30, which is attached to the distribution disk 28 in such a way that, with a cold spring 30, the air input to air supply channel 24*a* is opened for the top row of air supply openings 22*a* and all other air intakes are closed. With a warming of the bimetal spring, there is a continuous shift from channel 24*a* to channel 24*b*, then to channel 24*c*, and finally to channel 24*d*, while the other channels are shut off in turn. On the other hand, it is possible, by means of the thermal adjustment device 32, to determine the position of the movable flap 31 for the control opening 29. By not covering or only partial covering the control opening, movable flap 31 thus determines the total size of the control opening 29 and, in this manner, the total amount of combustion air supplied to the vertical shaft 11. A non-covering provides for a full heat output of the device, a partial covering for a reduced heat output. This can be adjusted by a user of the furnace, e.g., by means of a lever (not shown) on the outside of the furnace housing which is connected to the thermal adjustment device 32. The thermal adjustment device 32, which responds to heat, automatically takes care that this adjustment is not changed by the varying heating quality of the fuel, by varying flue conditions or by other such variables. Obviously, the opening size of the control opening 29, as determined by the adjustment device 32, does not change by the turning of the adjustment disk 28 which is determined by the bimetal spring 30.

The furnace, when including three rows of air supply openings as shown in FIG. 1, these rows being supplied with combustion air through these combustion air supply channels 24*a*, 24*b* and 24*c*, operates in the following manner. First, wood is filled into the vertical shaft 11 through the fill door 23 until it is completely filled. Then, the wood stack is lit on its top surface, the ash door 14 possibly being left open to help start the combustion. After combustion has commenced, the fill door 23 and the ash door 14 are closed. The supply of combustion air to the bed of embers forming on the top of the stack occurs through the air supply openings 22*a*, as, in a cold condition, the bimetal spring 30 holds the distribution disk 28 in such a position that the only air inlet opening to channel 24*a* is opened and the inlet openings to channels 24*b* and 24*c* are closed. Although combustion air enters also through the air intake passage 15, the ash box 13 and upwardly through the wood stack to the bed of embers, because of the small size of the air intake passage 15, this amount of combustion air is very small and only serves the purpose of keeping the low temperature carbonization gases in suspension and thus prevents their sinking down. The combustion gases enter the downdraft flues 16, 17 and flow down along them. Warmed secondary air passes through the secondary air vents 18 and 19 to mix with the combustion gases and provide secondary combustion thereof.

With continuing combustion, the bed of embers (combustion zone) slowly moves downwardly, with the effect that more and more heat is conveyed to the bimetal spring 30, which in turn slowly turns the distribution disk 28. As a consequence, the inlet opening 25a of the cover disk 26 leading to channel 24a is closed and, simultaneously, the opening 25b leading to channel 24b is opened. This means that the intake of combustion air is continuously transferred from the row of air supply openings 22a to the lower row of air supply openings 22b, so that the area directly above or around the bed of embers, and only this area, is provided with combustion air through these openings. With the further sinking of the bed of embers, the air supply openings 22b close in due course and the air supply openings 22c open up until, eventually, there is only combustion air supplied to the vertical shaft through the air supply opening 22c and the bed of embers has sunk down to the area of the grate 12.

As a result of the foregoing actions, a very even and hygienic combustion of the whole stack of wood in the vertical shaft 11 is attained, whereby the quality of the combustion is also positively influenced by the fact that the combustion air is preheated in the air supply channels 24a–24c. The total amount of air led in through the air supply channels 24a–24c is regulated by the adjustment device 32 or the movable flap 31, whereby a continuous adjustment between minimum and maximum heat output is possible. The total combustion time depends, on the one hand, on the amount of the stacked fuel and thus on the size of the vertical shaft 11, and, on the other hand, on the setting of the movable flap and the control opening. With a vertical shaft height of about 100 cm and a shaft cross section of about 800 $cm^2$, a combustion time of between 8 and 20 hours can be attained, depending on the output setting.

Many modifications to the invention can be made and still fall within the scope of the appended claims. For example, the number and arrangement of the combustion air supply openings can be varied. The aim should be to have, in a horizontal as well as in a vertical direction, as many separately adjustable combustion air supply openings as possible, in order to attain, on the one hand, as even as possible a supply of combustion air to the bed of embers from all sides, and, on the other hand, to be able to follow the sinking of the bed of embers continuously. In reality, however, 3 to 5 rows of openings should be sufficient for a furnace shaft with a height of about 100 cm, whereby they should be on the side wall of the shaft. To improve the continuity, it is also possible to arrange the rows at a slant in such a manner that the lowest opening of one row is located only very slightly above the top opening of the next lower row, etc. In a similar manner it is also possible to provide the cover disk with several intake openings per channel, or to install intake slits for attaining a continuous adjustment. For this purpose, the control element does not have to be a punched disk, but can also be constructed in other ways. The drive of the punched disk can be manual, in which case it is advantageous to provide the furnace housing with viewing windows. If the punched disk is adjusted automatically, which is to be preferred, other heat sensors, apart from bimetal springs, which respond to heat transfer, convection or radiation, are also usable. Clock movements can also be used, particularly if their timing is coupled to the control element (movable flap) for the high-low adjustment.

In order to secure a particularly sharply defined combustion zone, it is advantageous to design the combustion air supply openings as small as possible and to supply the combustion air to the bed of embers in accordingly sharp jets at high air speed. In this case it is suitable to mount an air ventilator upstream of the combustion air inlet openings or to connect a suction fan downstream of the furnace. The small combustion air supply openings of the furnace shaft could be constructed as nozzles, which can be directed horizontally or slightly upwardly. Finally, it should be pointed out that the furnace can have any desired size, e.g., furnace shafts with heights of several meters, and passing, for example, through the two floors of a building, are easily possible.

If desired, it is certainly also possible to operate the furnace according to the burn-out principle, for example, when the wood stack is almost fully burned and an extension of the heat supply is desired, wood can be added through the fill door, which is then lit by the bed of embers near the grate and will burn down, whereby only the lowest row of combustion air supply openings will be open and will remain so, with the resulting burn-out. According to another embodiment of the invention it is possible to also improve the mixing in of the secondary air into the waste gases. With continuous combustion, and thus sinking of the bed of embers, the bed will become located further and further away from the secondary air vents 18, 19, with the effect that there is very little post-combustion of the waste gases and thus the secondary air only provides for a dilution of the waste gases. On the other hand, there will be combustion air supply openings located considerably above the bed of embers and, according to the described mode of operation, no longer supply combustion air, yet are in a place suitable for the supply of secondary air. It is thus also possible, with a sinking bed of embers, to open the corresponding row of combustion air supply openings, such as row 22b, and, instead of the corresponding closing of row 22a, close the vents 18, 19 and leave a part of row 22a open, corresponding to the cross section of the vents 18 and 19. In this case, the air coming through the openings 22a, which originally was combustion air, now takes over the function of secondary air. With continuing sinking of the bed of embers and thus opening of the combustion air supply openings 22c, the row 22a is closed and a partial cross section of row 22b remains open. If the furnace is to be operated with only a partial filling of fuel, there should also be an indicator for the filling height for manual presetting to partial fill, so that the distribution disk gets such a presetting that on lighting (cold device) a lower row of combustion air supply openings, depending on the fill level, is opened.

I claim:

1. A process for the controlled combustion of a vertical stack of solid fuel which comprises the steps of igniting the top of said vertical stack of solid fuel such that combustion will commence at the top of said vertical stack and move downwardly towards its bottom as a moving zone of combustion, supplying a minor portion of the air necessary for combustion of said solid fuel in said vertical stack to the bottom of said vertical stack, supplying a major portion of the combustion air necessary for combustion of said solid fuel in said vertical stack to the side of said vertical stack, all of said major portion of the combustion air being gradually supplied to said vertical stack at sequentially lower, generally horizontal levels thereof as said zone of combustion moves downwardly along said vertical stack, and removing waste combustion gases from the top of said vertical stack.

2. The process as defined in claim 1, wherein said solid fuel comprises wood.

3. A furnace for burning solid fuel in a controlled manner, said furnace comprising a housing having a fill door, a vertical furnace shaft mounted in said housing for receiving solid fuel supplied to said housing through said fill door, said vertical shaft having an open upper end and a bottom end and combustion air supply openings in its side at different vertical levels along its length for supplying a major portion of the required combustion air to the solid fuel therein, a grate located at the bottom of said vertical shaft through which a minor portion of the combustion air needed to burn the solid fuel therein can enter said vertical shaft, means forming downwardly-extending waste gas channels within said housing and outside of said vertical shaft, said waste channels conveying waste combustion gases passing through the open upper end of said vertical furnace shaft downwardly and out of said housing, means forming secondary air vents communicating with said downwardly-extending waste gas channels near their upper ends in communication with the open upper end of said vertical shaft so as to secondarily burn combustion gases coming from said vertical shaft, and means for supplying adjustable amounts of combustion air to said respective combustion air inlet openings in the side of said vertical furnace shaft.

4. The furnace as defined in claim 3, wherein said combustion air supply openings comprise a plurality of openings distributed in rows which are spaced apart at levels along the length of said vertical furnace shaft.

5. The furnace as defined in claim 4, wherein each of said rows of openings are horizontal.

6. The furnace as defined in claim 4, wherein each of said rows is slightly inclined, the lowest opening of one row being higher along the length of te vertical furnace shaft than the highest hole in the next lower row.

7. The furnace as defined in claim 4, including a separate combustion air supply channel for supplying combustion air to the combustion air supply openings in each row of said openings.

8. The furnace as defined in claim 7, wherein said combustion air supply channels have respective inlet openings located next to each other, and including a distribution device for determining the amount of combustion air entering the inlet opening of each of said combustion air supply channels.

9. The furnace as defined in claim 8, wherein said inlet openings are located around the periphery of a fixed cover disk, and wherein said distribution device comprises a distribution disk having a control opening therein, said distribution disk being rotatable relative to said fixed cover disk to uncover, partially cover or fully cover the inlet openings therein.

10. The furnace as defined in claim 9, including a temperature-sensitive bimetallic spring attached to said distribution disk to determine its rotational position relative to said fixed cover disk, the temperature of said bimetallic spring being based on the location relative thereto of the zone of combustion along the length of said vertical furnace shaft.

11. The furnace as defined in claim 10, wherein said distribution disk includes a movable flap which can partially cover the control opening therein, and including a thermal adjustment device attached to said movable flap to move it relative to said control opening.

12. The furnace as defined in claim 11, including a closed chamber surrounding said distribution disk, said closed chamber having a flue opening therein.

13. The furnace as defined in claim 12, including an air ventilator connected to said closed member to supply a flow of pressurized combustion air thereto.

14. The furnace as defined in claim 3, including a closed ash box located below said grate, and including an air intake passage extending to said ash box, the total cross section of the combustion air supply openings in each row of said openings being greater than the cross secton of said air intake passage.

15. The furnace as defined in claim 3, wherein said combustion air supply openings are formed by nozzles which are slightly upwardly oriented.

16. The furnace as defined in claim 3, wherein said means forming secondary air vents comprise vertical preheating channels which extend upwardly along the outside of said vertical shaft, said vertical preheating channels having air vents at their upper ends.

17. The furnace as defined in claim 16, including means for closing said vertical preheating channels.

* * * * *